United States Patent [19]

Fujii et al.

[11] 4,203,403

[45] May 20, 1980

[54] IGNITION DEVICE FOR AN INTERNAL COMBUSTION ENGINE

[75] Inventors: Hideo Fujii; Minoru Kato, both of Kariya, Japan

[73] Assignee: Nippondenso Co., Ltd., Kariya, Japan

[21] Appl. No.: 739,800

[22] Filed: Nov. 8, 1976

Related U.S. Application Data

[62] Division of Ser. No. 463,429, Apr. 23, 1974, Pat. No. 4,028,844.

[30] Foreign Application Priority Data

Apr. 28, 1973 [JP] Japan ..... 48/51468

[51] Int. Cl.[2] ..... F02P 1/00

[52] U.S. Cl. ..... 123/148 AC; 123/148 S; 123/149 A

[58] Field of Search ..... 123/148 E, 148 AC, 148 S, 123/148 CC, 148 DC, 148 R, 149 A, 149 D, 149 C

[56] References Cited

U.S. PATENT DOCUMENTS

| | | | |
|---|---|---|---|
| 2,382,808 | 8/1945 | Ochsenbein | 123/148 AC |
| 2,450,404 | 9/1948 | Bohn | 123/148 AC |
| 2,790,914 | 4/1957 | Dingman | 123/148 AC |
| 3,183,902 | 5/1965 | Wicklund | 123/148 AC |
| 3,362,389 | 1/1968 | Johnson | 123/41 |
| 3,435,264 | 3/1969 | Brand et al. | 123/148 AC |
| 3,518,978 | 7/1970 | Schmiedel | 123/41 |
| 3,548,800 | 12/1970 | Lombardini et al. | 123/148 E |
| 3,554,179 | 1/1971 | Burson | 123/148 CC |
| 3,648,675 | 3/1972 | Gemander | 123/41 R |
| 3,759,237 | 9/1973 | Shino et al. | 123/148 AC |
| 3,788,293 | 1/1974 | Anderson | 123/148 DC |
| 3,795,235 | 3/1974 | Donohue et al. | 123/148 CC |
| 3,826,236 | 7/1974 | Carlsson | 123/148 E |

FOREIGN PATENT DOCUMENTS

| | | | |
|---|---|---|---|
| 415761 | 9/1934 | United Kingdom | 123/149 C |
| 1222999 | 2/1971 | United Kingdom | 123/148 E |

OTHER PUBLICATIONS

Cams-Design, Dynamics, and Accuracy H. A. Rothbart Copywright 1956, pp. 30–58, 94–96.

*Primary Examiner*—Ira S. Lazarus
*Assistant Examiner*—Andrew M. Dolinar
*Attorney, Agent, or Firm*—Cushman, Darby & Cushman

[57] ABSTRACT

This invention relates to an ignition device for an internal combustion engine, in which a primary winding of an ignition coil and a breaker contact are connected in series and the breaker contact is so designed that wanted high voltages are produced only when the breaker contact is opened, whereby the engine is prevented from rotating in a reverse direction.

3 Claims, 6 Drawing Figures

IGNITION DEVICE FOR AN INTERNAL COMBUSTION ENGINE

This is a division of our copending application Ser. No. 463,429, filed Apr. 23, 1974, now U.S. Pat. No. 4,028,844.

BACKGROUND OF THE INVENTION

1. Field of the Invention

The present invention relates to an ignition device which may be employed in 2-cycle engines for motorcycles or snowmobiles, especially to an ignition device having a contact point in which a magneto generator is used as an electric power source.

2. Description of Prior Art

In a conventional ignition device especially employed in a 2-cycle engine, a magneto generator is used as an electric power source, and a breaker contact and a primary winding of an ignition coil are connected in parallel to a generating coil of the magneto generator. In the ignition device of this kind, several high voltages other than that of a normal ignition timing are induced at a spark plug while the breaker contact opens. It comes from the fact that when the magnetic flux flowing through the generating coil changes from one direction to the other at a specific point, which is hereinafter referred to as a magnetically neutral point, change of the magnetic flux induces a sufficient high voltage to produce an ignition spark. These induced high voltages at the magnetically neutral points do not influence the engine operation during the normal running of the engine, since the high voltages are produced after the ignition spark at the normal ignition timing produced when the breaker contact opens, and further they are after a top deadcenter. However, when the engine rotates in the reverse direction by accident, the induced high voltages may be produced before and near the top deadcenter so that sufficient combustion energy is obtained to continue the reverse rotation of the engine.

SUMMARY OF THE INVENTION

It is therefore a primary object of the present invention to provide an ignition device which prevents a reversely rotated engine from producing such combustion as to cause continual rotation in the reverse direction by such induced voltages.

It is another object of the present invention to provide an ignition device in which a generating coil of a magneto generator, a primary winding of an ignition coil and a breaker contact are connected in series and a timing of opening the breaker contact and an induced voltage are selected after the top deadcenter, during the reverse rotation of the engine.

It is a further object of the present invention to provide an ignition device which is free from abnormal firing during the normal rotation of the engine.

It is a furthermore object of the present invention to provide an ignition device in which there is provided means for invalidating induced voltage produced by change of magnetic flux flowing through the generating coil.

DESCRIPTION OF THE PREFERRED EMBODIMENT

Figure 1:
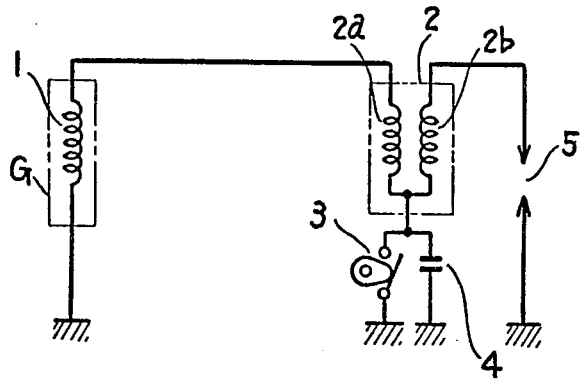
FIG. 1 is an electric wiring diagram showing the first embodiment of the present invention.

Now referring to FIG. 1 showing the first embodiment of the present invention, a letter G designates a well-known magneto generator which comprises a rotor and a stator mounting a generating coil 1 energized by said rotor. A numeral 2 designates an ignition coil having a primary winding 2*a* and a secondary winding 2*b*. Each one end thereof is connected together and is grounded to the earth through a parallel circuit of a breaker contact 3 and an arc-suppressing capacitor 4. The other end of said primary winding 2*a* is connected to a non-grounded end point of said generating coil 1 while the other end of said secondary winding 2*b* is grounded through a spark plug 5.

In this embodiment, the cam-open-angle is selected to be such a value as to prevent the induced voltage which is not necessary for the ignition spark from being produced at the ignition coil 1.

Figure 2:
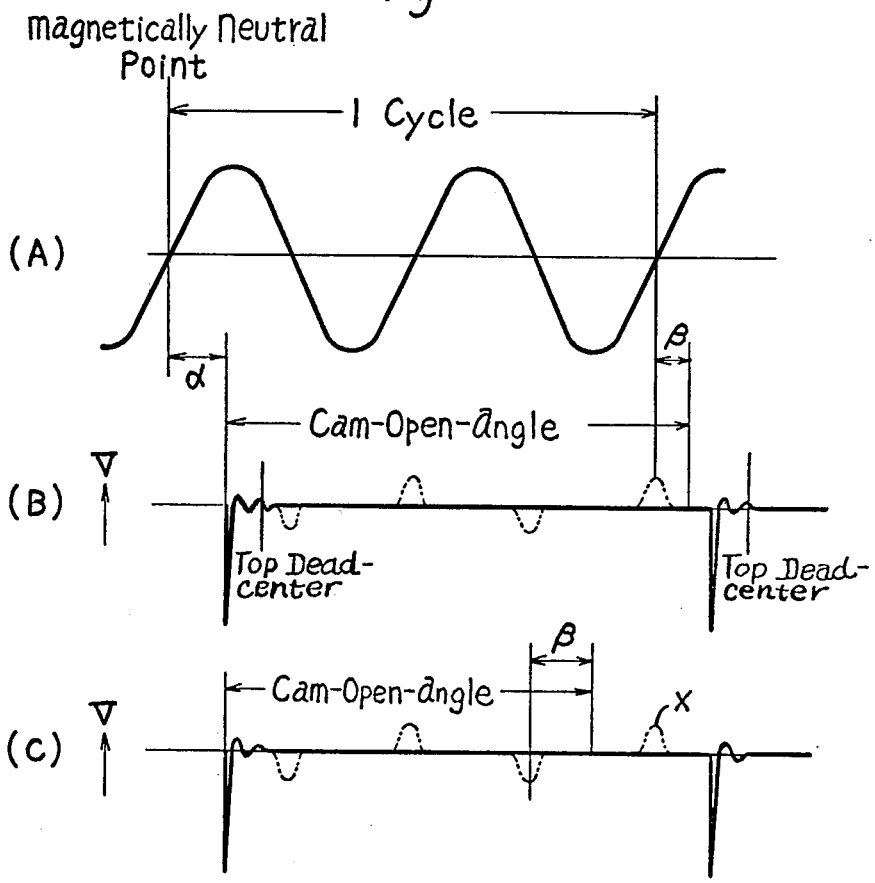
FIGS. 2 and 3 are waveform diagrams for explaining the operation of the present invention.

The value of the cam-open-angle Z is determined by the following equation (A);

$$Z = \left(\frac{360^\circ}{P} - \alpha\right) + \frac{360^\circ}{P} X(P - 1) + \beta \qquad \text{(A)}$$

wherein,

P; number of magnetic poles of the magneto generator, $\alpha$; value of an angle from the magnetically neutral point shown in FIG. 2 (A) to the opening point of the breaker contact 3, and $\beta$; value of an angle from the magnetically neutral point to the closing point of the breaker contact 3.

Here, examples of a four-pole and a six-pole magneto generators will be explained, whose waveforms are respectively shown in FIGS. 2 and 3, in which "1 cycle" indicates a period during which the engine rotates one time.

When each value of $\alpha$ and $\beta$ is respectively selected to be 20 degrees and 10 degrees for both a four-pole magneto generator and a six-pole magneto generator, the value of the cam-open-angle for both generators is determined at 350 degrees.

Figure 3:
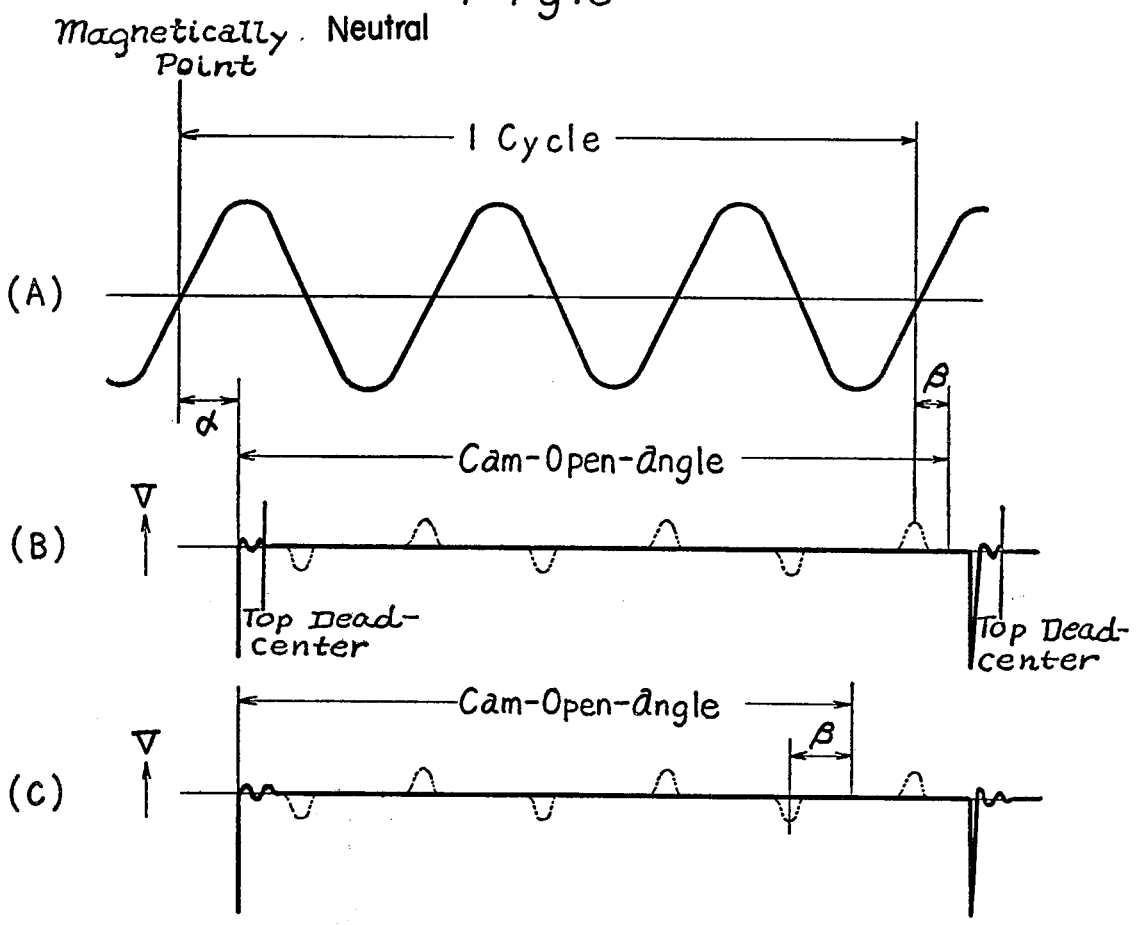

With either one of above mentioned generators, when it is rotated in the normal direction, the ignition voltage is generated when the breaker contact 3 is opened as shown in FIG. 2 (B) or FIG. 3 (B). Needless to say, the breaker contact 3 opens before a top deadcenter of the engine as shown in FIGS. 2 and 3.

It is noted that the high voltage to be otherwise induced at the magnetically neutral points as shown by dotted lines in FIGS. 2 (B) and 3 (B) are not produced, since the neutral points are embraced by the cam-open-angle, thereby preventing the abnormal firing.

When the engine rotates in the reverse direction by accident, for example, when a motorcycle moves backward on a sloping road, an ignition spark is produced just at a point where the breaker contact 3 opens, in other words, at the point where the breaker contact 3 closes during the normal running of the engine. As clearly noted from FIGS. 2 and 3, the point is located behind the top deadcenter where the engine can not obtain sufficient energy to continue the reverse rotation even though the ignition spark is produced, so that continuous reverse rotation of the engine is prevented.

It is further noted that especially in a four-pole or six-pole magneto generator, abnormal firing may be caused by the induced voltage which is produced at the neutral point just before the normal ignition timing, that the phase or the polarity of this induced voltage is different from that of the high voltage at the normal ignition timing, and therefore that the abnormal firing can be prevented by selecting the value of the cam-open-angle which is subtracted by an angle of (360°/ the number of magnetic poles ) from the value of the cam-open-angle determined by said equation (A), and providing invalidating means comprising a polarity discriminating element such as a diode.

Accordingly the value of the cam-open-angle Z is determined by the following equation (B);

$$Z = \left(\frac{360^\circ}{P} - \alpha\right) + \frac{360^\circ}{P} X(P-2) + \beta \qquad \text{(B)}$$

wherein,

P; number of magnetic poles of the magneto generator, $\alpha$; value of an angle from the magnetically neutral point to the opening point of the breaker contact, and $\beta$; value of an angle from the magnetically neutral point to the closing point of the breaker contact.

Figure 4:
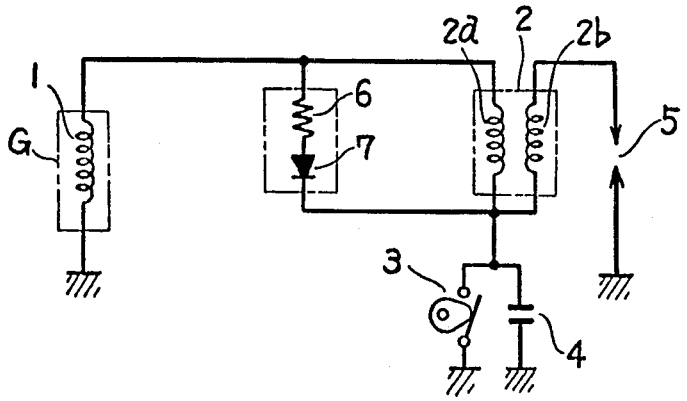
FIGS. 4, 5 and 6 are electric wiring diagrams showing the second, third and fourth embodiments of the present invention.

FIG. 4 shows the second embodiment of the present invention, in which said invalidating means which is a series circuit of a resistor 6 and a diode 7 is connected in parallel with the primary winding 2*a* of the ignition coil 2. When the induced voltage is generated at the generating coil just before the normal ignition timing, the induced voltage is bypassed through the series circuit of the resistor 6 and the diode 7, whereby the high voltage at the ignition coil is substantially invalidated.

An operation of the second embodiment will be explained with reference to FIG. 2 showing the waveforms for a four-pole magneto generator. As the cam-open-angle is determined by said equation (B), three of the high voltages induced at the magnetically neutral points are embraced by the cam-open-angle as shown in FIG. 2 (C) thereby preventing them from being produced. And the last high voltage, which is indicated by a letter X in FIG. 2 (C), induced at the magnetically neutral point just before the normal ignition timing is broken down by said series circuit of the resistor 6 and the diode 7. Therefore the abnormal firing of the engine due to the induced high voltages at the magnetically neutral points is prevented during the normal running of the engine. And further the reverse rotation of the engine by accident is also prevented from continuing in like manner as described as for the first embodiment, in which the ignition spark is caused behind the top deadcenter during the reverse rotation of the engine.

An operation of the six-pole magneto generator is almost same as that of the four-pole magneto generator and therefore it is omitted.

Now when each value of $\alpha$ and $\beta$ is selected for instance to be 20 degrees and 25 degrees for the four-pole magneto generator and 20 degrees and 15 degrees for the six-pole magneto generator, the values of the cam-open-angle shown in FIGS. 2 (C) and 3 (C) are repectively determined at 275 degrees and 295 degrees.

In the FIG. 4 embodiment, the value of the resistor is so selected, as a value of 1.5 Ω, that this invalidating operation is performed without any influence on the high voltage at the normal ignition timing.

Figure 5:
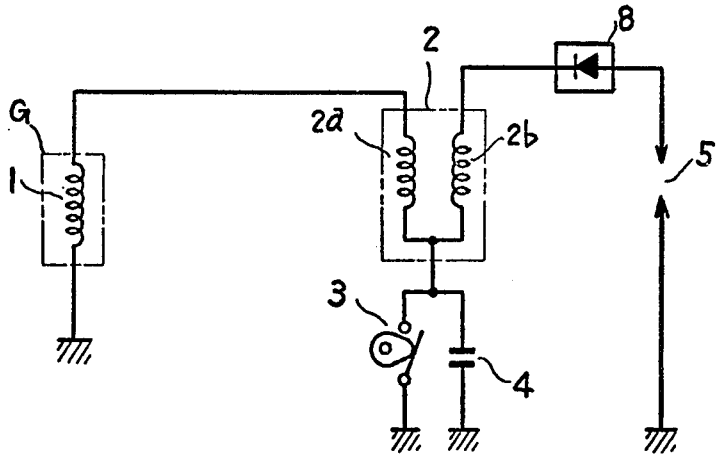

FIG. 5 shows the third embodiment of the present invention, in which a high-voltage-resisting diode 8 is connected between the secondary winding 2*b* of the ignition coil 2 and the spark plug 5, whereby the undesirable induced voltage is eliminated by the diode 8 in like manner described above.

Figure 6:
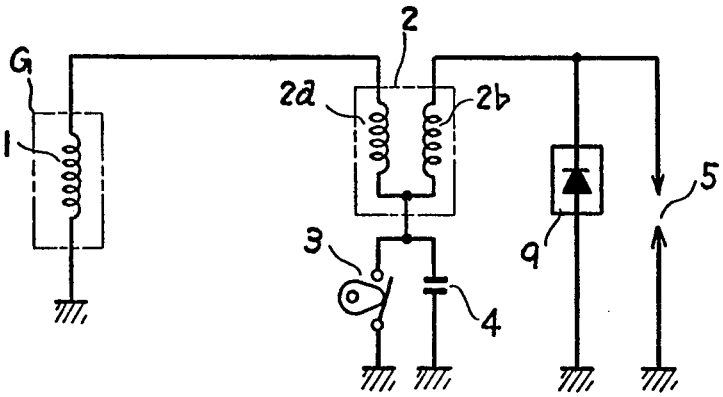

FIG. 6 shows the fourth embodiment of the present invention, in which the high-voltage-resisting diode 9 is connected in parallel with the spark plug 5.

An operation of the fourth embodiment is almost same as the second and third embodiments.

What we claim is:

1. For a 2-cycle internal combustion engine having at least one spark plug, an ignition device having a generating coil and at least a four-poled rotor for generating a plurality of positive and negative half waves in one rotation cycle and providing a plurality of magnetically neutral points during said cycle;

an ignition coil having a primary winding connected in series with said generating coil and a secondary winding;

breaker contacts connected in series with said primary winding;

cam means synchronized with said engine during a forward rotation of said engine for opening said breaker contacts at the start of said cycle at one of said neutral points while one half wave of said negative and positive waves is being generated at said generating coil to produce an ignition spark at said spark plug and maintaining said breaker contacts open until closing them at a time between the last two of the said magnetically neutral points in a cycle; and a rectifier connected with said ignition coil so as to prevent voltage being induced in said secondary winding by the other half wave of said positive and negative half waves.

2. An ignition device for a 2-cycle internal combustion engine comprising:

a spark plug;

a multi-poled magneto generator having a generating coil and being rotatable in synchronism with the engine for generating a plurality of positive and negative half waves in one rotation and providing a plurality of magnetically neutral points;

an igntion coil having a primary winding connected in series with said generating coil and a secondary winding connected to said spark plug;

breaker contacts connected in series with said primary winding;

cam means synchronized with said engine during forward rotation for opening said breaker contacts during a one half wave of said positive and negative half waves beginning at an angle $\alpha$ past an adjacent one of said magnetically neutral points for an angular duration Z which ends by closing said breaker contacts at an angle $\beta$ past another adjacent one of said magnetically neutral points, and a rectifier connected with said ignition coil so as to prevent voltage induced in said secondary winding by the other half waves of said positive and negative half waves;

said angular duration Z being determined by the following equation $$Z = \left(\frac{360^\circ}{P} - \alpha\right) + \frac{360^\circ}{P} \times (P - 2) + \beta,$$

said rectifier being connected in parallel with said secondary winding.

3. An ignition device for a 2-cycle internal combustion engine comprising:

a spark plug;

a multi-poled magneto generator having a generating coil and being rotatable in synchronism with the engine for generating a plurality of positive and negative half waves in one rotation and providing a plurality of magnetically neutral points;

an ignition coil having a primary winding connected in series with said generating coil and a secondary winding connected to said spark plug;

breaker contacts connected in series with said primary winding;

cam means synchronized with said engine during forward rotation for opening said breaker contacts during a one half wave of said positive and negative half waves beginning at an angle $\alpha$ past an adjacent one of said magnetically neutral points for an angular duration Z which ends by closing said breaker contacts at an angle $\beta$ past another adjacent one of said magnetically neutral points, and a rectifier connected with said ignition coil so as to prevent voltage induced in said secondary winding by the other half waves of said positive and negative half waves;

said angular duration Z being determined by the following equation $$Z = \left(\frac{360^\circ}{P} - \alpha\right) + \frac{360^\circ}{P} \times (P - 2) + \beta,$$

said rectifier being connected in series with said secondary winding and spark plug.

* * * * *